United States Patent [19]

Zollinger

[11] Patent Number: 4,646,657

[45] Date of Patent: Mar. 3, 1987

[54] COLLAPSIBLE TABLE

[76] Inventor: Hansrudolf Zollinger, Zurcherstrasse 72, Oberengstringen, Switzerland

[21] Appl. No.: 597,519

[22] Filed: Apr. 6, 1984

[30] Foreign Application Priority Data

Apr. 11, 1983 [CH] Switzerland ..... 1940/83

[51] Int. Cl.[4] ..... A47B 3/00

[52] U.S. Cl. ..... 108/113; 108/112; 108/115

[58] Field of Search ..... 108/113, 44, 112, 115, 108/129, 132, 78, 67, 68; 312/297; 52/9, 7

[56] References Cited

U.S. PATENT DOCUMENTS

| | | | |
|---|---|---|---|
| 264,886 | 9/1882 | Kennerly | 108/78 |
| 737,455 | 8/1903 | Noble | 108/112 |
| 2,587,159 | 2/1952 | Holmes | 280/35 X |
| 2,792,270 | 5/1957 | Anderson | 108/112 |
| 2,831,741 | 4/1958 | Wilson | 108/113 |
| 3,091,816 | 6/1963 | Wetzel | 108/112 |
| 3,173,708 | 3/1965 | Machielse et al. | 280/79.1 A X |
| 3,338,591 | 8/1967 | Rowland | 280/79.1 A |

*Primary Examiner*—Kenneth J. Dorner
*Assistant Examiner*—José V. Chen
*Attorney, Agent, or Firm*—Helfgott & Karas

[57] ABSTRACT

A collapsible table comprises table leaf and leg elements, the table leaf elements being either hinged to one another or to table leg elements. This non-detachable connection of the elements permits the table to collapse in an accordian-like manner into a small space, and to be loaded and transported on a chassis. The assembled table can be prevented from collapsing by a displaceable retaining bolt located at the abutting joints of two table leaf elements. By hinging the elements, tables with a random table surface size can be obtained, while being assembled, disassembled and stored in a simple manner.

15 Claims, 6 Drawing Figures

COLLAPSIBLE TABLE

FIELD OF THE INVENTION

The present invention relates to a collapsible table formed from two or more hingedly coupled table leaf elements and table leg elements.

BACKGROUND OF THE INVENTION

Various designs of collapsible tables are known. Conventional round tables are constructed with the table leaf in two parts, the leaf halves being placed upon one another and turned with respect to the table leg frame or trestle. As a result, the surface occupied is reduced by half.

In another known construction, the table surface comprises individual, juxtaposed table leaves. The conventional leaves with rounded ends are connected to the table leg frame or trestle. The small table surface can be achieved by telescoping the frame or trestle, and is a round or oval. If a larger table surface is required, the table leg frame is extended and the number of leaves necessary to obtain the desired table surface are introduced between the end leaves.

In another known construction, the table legs are foldably coupled to the table leaf. As a result, the table leaf with the table legs attached thereto can be housed in a small space. However, the table surface cannot be made smaller or larger. If a larger table surface is needed, several tables must be connected together.

The first two constructions discussed above are disadvantageous in that the minimum table surface is still relatively large. In the case of the third construction discussed above, the table size cannot be varied.

SUMMARY OF THE INVENTION

Objects of the present invention involve providing a collapsible table that can rapidly produce a table having a random size and can be speedily dismantled and stored with relatively little manual effort.

The foregoing objects are obtained by a collapsible table with the table leaf elements and table leg elements interconnected by hinges. Two table leaf elements are hinged to one another at adjacent leaf edges. At the opposite leaf edges, two table leg elements are hinged.

By forming the table in this manner, the table can be easily and quickly assembled to various sizes. Additionally, the table can be simply and quickly disassembled for efficient storage.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a a part of this disclosure.

DETAILED DESCRIPTION OF THE PREFERRED EMBODIMENTS OF THE INVENTION

Figure 1:
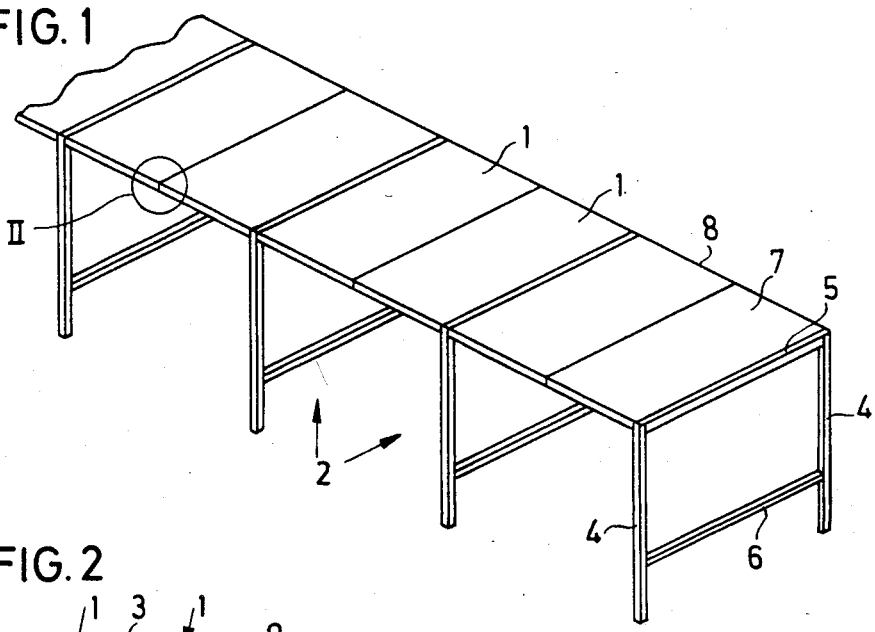
FIG. 1 is diagrammatic perspective view of a collapsible table according to a first embodiments of the present invention.

Referring initially to FIG. 1, the table comprises table leaf elements 1 and table leg elements 2. The individual elements 1 and 2 are pivotally coupled to one another by hinges, which hinges are not visible in FIG. 1. The sequence of elements 1 and 2 is as follows. The table begins at one end with a table leg element 2, to which are connected two table leaf elements 1. This is again followed by a table leg element 2, to which are connected two table leaf elements 1, etc. The opposite end of the table again ends with a table leg element 2.

Figure 2:
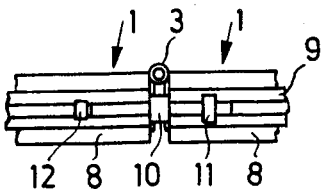
FIG. 2 an enlarged diagrammatic side elevational view of detail II in FIG. 1.

The hinged connection between the individual elements 1, 2 comprises hinge bands or joints 3 as illustrated in FIG. 2. The connection between the table leaf elements 1 and the table leg elements 2 is similar.

The table leg element 2 is a frame comprising rods or tubes, e.g. square tubes, and having two table legs 4, an upper crossarm 5 and a lower crossarm 6 arranged in spaced manner over the ground. When the table is assembled, the top surface of upper crossarm 5 is coplanar with the top surface of leaf embodiments 1, thereby forming part of the table surface.

The table leaf elements 1 have a table leaf 7 with hinges 3 fixed to its two opposite edges. On the other or side edges 8 of table leaf 7 forming the longitudinal side of the table, mounting supports are provided. With the mounting supports, juxtaposed table leaves are held in their extended position as shown in FIG. 2.

FIG. 2 illustrates the joint abutment between two table leaf elements 1 with intermediate hinge band 3. A profile rail 9 with a U-shaped cross-sectional configuration is fixed to the side faces of edge 8. A retaining bolt 10 is mounted with the U-shaped profile of rail 9, which bolt can by moved by means of a handle 11. In the position shown in FIG. 2, retaining bolt 10, which can be a metal bar, extends across the joint between two table leaf elements 1 so that folding of the leaf elements at the hinge is no longer possible. The correct position of the retaining bolt 10 is determined by a stop member 12.

The table shown in FIG. 1 forms a collapsible entity because table leaf elements 1 and table leg elements 2 are interconnected by the hinge bands 3. As a result, assembly, disassembly and storage can be carried out in a simplified manner and as will be described relative to FIG. 3.

Figure 3:
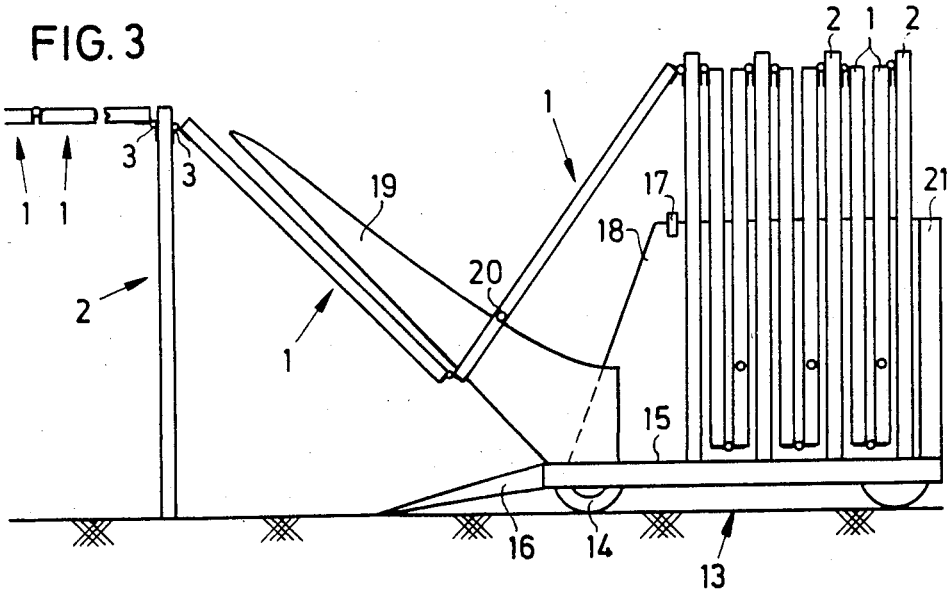
FIG. 3 a diagrammatic side elevational view of the assembly and disassembly of the table of FIG. 1 using a chassis.

FIG. 3 illustrates how the table according to FIG. 1 is assembled. The table is stored in a folded or collapsed manner in a chassis 13 and is transported by means of the chassis to the point at which the table is to be erected. The chassis is equipped with rollers 14. FIG. 3 shows some table leaf elements 1 and table leg elements 2 after they have been erected, and two table leaf elements as they are just about to be transferred into their extended position. The table assembly operation then takes place in the following manner.

The vertically positioned table leaf and leg elements 1, 2 on chassis 13 are continuously removed by a ramp 16 located on the base 15 of chassis 13. As illustrated in FIG. 3, only table legs 4 rest on the base 15. By suitable surface treatment, the displacement of the individual elements can be facilitated. Manual assistance may be necessary at the start of table erection process.

To ensure that only a single table leg element 2 and two table leaf elements 1 simultaneously slide over ramp 16, a displaceable stop member 17 is mounted on one of the side walls 18. On retracting chassis 13, table legs 4 slide over ramp 16 and pulling two following table leaf elements 1 therewith.

To facilitate the movement of the two table leaves into their extended or assembled position, a sliding or guiding member 19 is fixed to the chassis. Pins 20, arranged on the lateral edges of the leaf elements, slide on guiding member 19. Guiding member 19 can be arranged on only one side or both sides of elements 1, 2. Pin 20 is only placed on one of the two associated table leaf elements 1 which are directly hinged together.

By retracting chassis 13, each table leg element 2 and the two following table leaf elements 1 are successively removed until the complete table has been erected. If the complete table is not to be erected, after erecting the desired table surface, the chassis with the remaining elements 1, 2 can be left at one table end. For this purpose, guiding member 19, and optionally ramp 16 can be constructed so that they can fold back.

On disassembling the table, chassis 13 is moved in the opposite direction, i.e., against the table. The individual table leg elements with the associated table leaf elements 1 are moved via ramp 16 onto base 15. For this purpose, retaining bolt 10 must first be retracted. The guiding member 19 can also be moved back so that the weight of the table leaf elements during movement from the horizontal position to the vertical position assists in sliding of table legs 4 of the particular table leg element 2. The end position of elements 1, 2 on chassis 13 is defined by rear wall 21.

Loading and unloading elements 1 from and onto chassis 13 can be facilitated by additional means, e.g., by constructing base 15 as a conveying plane. The conveying plane moves in accordance with the movement of the chassis. During the assembly of the table, the plane assists the removal of the elements. During the disassembly, it assists the fitting of elements 1, 2.

After ramp 16 and guiding member 19 are pivoted to their storage position, the load chassis 13 occupies virtually no more space than that required by the folded elements 1, 2.

In FIG. 1, table leaves 7 have the same width as upper crossarm 5. However, the table could also be constructed with correspondingly larger table leaves and correspondingly larger upper crossarms 5, without changing the assembly and disassembly operations.

If the table shown in FIG. 1 is to be made more stable, the mounting support of FIG. 2 can be replaced by a further table leg element 2' as illustrated in FIG. 4. Leg element 2' is pivotally coupled by a hinge 3 in articulated manner to the bottom of one of two connected table leaves 7 adjacent the joint therebetween. Otherwise, the construction of the table or its table units is the same as in the embodiment of FIG. 1. Such unit comprises two table leaf elements 1 and two table leg elements 2, which are hinged together. The table leg elements 2 are hinged to the free terminal edges of the two table leaf elements 7 by hinges 3.

Leg element 2 need not be constructed as a frame, but can have only a single table leg 4. The width of crossarm 5' between its opposite longitudinal ends is larger than the width or thickness of table leg 4 between its longitudinal sides. In addition, the leg is fixed flush on one side with crossarm 5'. Below the projecting part of crossarm 5', a space is provided for receiving further table leg element 2' replacing the mounting support of the embodiment of FIG. 1. In table unit A, which has almost been completely housed in chassis 13 in FIG. 4*a*, table leg element 2' is folded over and stored below the projecting part of crossarm 5'. The final position of the table unit A in the chassis 13 can be gathered from phase B, which also shows how the connected table unit B is folded down. For this purpose, table leg element 2 is moved over a ramp 22 of side wall 23 and is raised so that table leg unit 2' is also raised. This is achieved since crossarm 5' is wider than the table leaves 7 in a direction perpendicular to the plane of the drawing. This also makes it possible for the two table leaf elements 1 to be brought into the vertical position between the two chassis side walls 23 (one side wall is broken away in FIGS. 4*a–c*) and between two guiding members 24 (one guiding member 24 is also broken away) within side walls 23.

The two guiding members 24 are arranged at a limited distance from side walls 23, and engage and guide pins 25 fixed on either side of one of the two table leaves 7 of a table unit. The pins enable the table leaf to be guided on guiding members 24. As the chassis 13 is moved in the direction of arrow 21 during the three phases illustrated respectively in FIGS. 4 *a, b* and *c*, two table leaf elements 1 drop, as a result of their own weight, and are guided by pins 25 on the two guiding members 24. When the table leaf elements 1 assume their vertical position, the pin 25 is removed from guiding member 24 (see FIG. 4*a*).

A guide ram 26 is fixed to side walls 23 and is used for raising the table leg element 2', replacing the mounting support of FIG. 2. On further lowering of the table leaf elements 1, table leg element 2' can enter the space below crossarm 5'. On further displacement of chassis 13, table unit B assumes the position of table unit A in FIG. 4. The folding or collapsing of successive table units takes place in this way.

Guiding member 24 is particularly necessary when assembling the table because it assists in moving table leaf elements 1 from the vertical position to the horizontal position. The assembly process is similar to the disassembly process, but in the reverse direction, i.e., from FIG. 4*c* to 4*a*, with chassis 13 travelling in a direction opposite to arrow 21. The raising of the table unit with the aid of crossarm 5' raises table leg elements 2' so that elements 2' can be pivoted. The hinge for this table leg element 2' is provided on the table leaf element 1 which is connected to the projecting part of crossarm 5'. Pin 25 does not project as far as crossarm 5' so that the table leg element 2 is guided on side wall 23, while pin 25 is guided on the more inwardly positioned guiding member 24.

The individual parts of the presently described table can be made from various materials. For example, table leaves 7 can be coated or veneered chipboard, while table legs 4 and crossarm 5, 5', 6 can comprise square tubes of light metal, steel, plastic or wood. The joints are preferably commercially available hinges of random length and made from metal. The C-profile rails 9 can be made from metal, e.g., light metal.

Figure 4A:
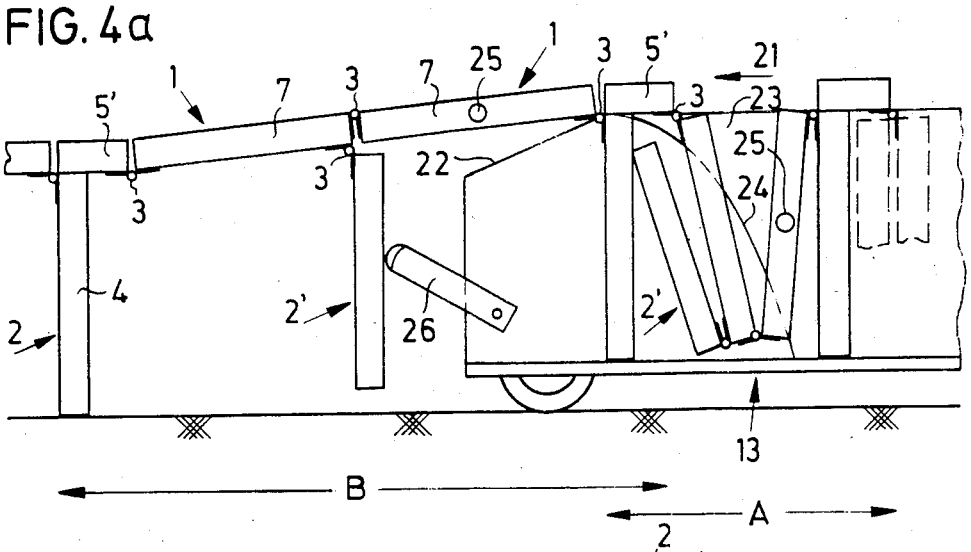
FIGS. 4 *a, b* and *c* are diagrammatic side elevational views of the assembly and disassembly of a collapsible table using a chassis according to a second embodiment of the present invention.
Figure 4B:
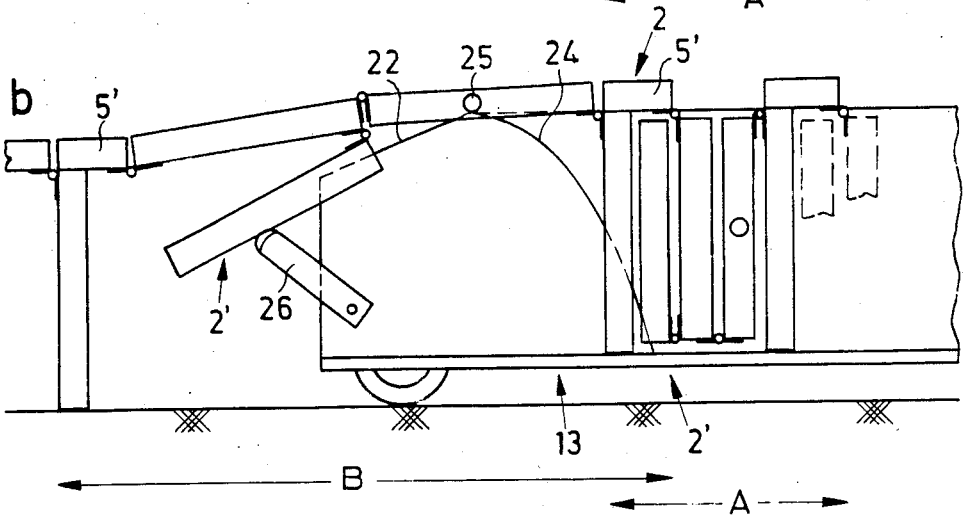
Figure 4C:
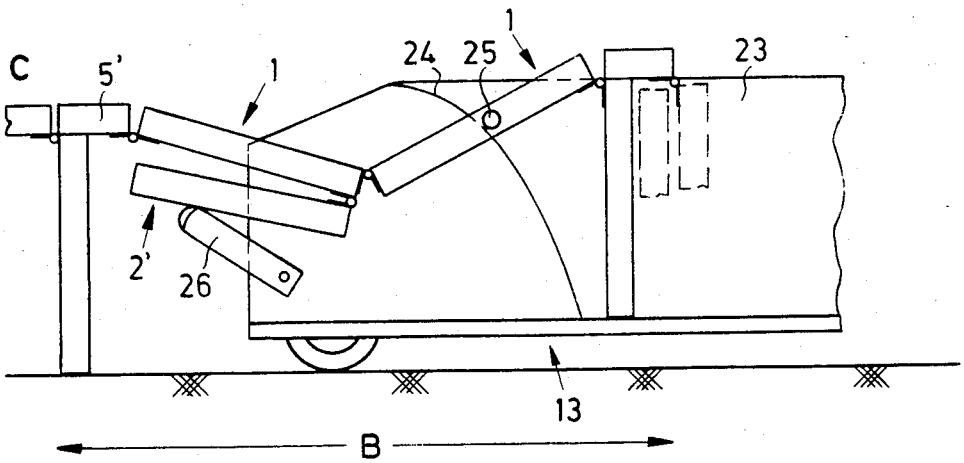

A variant of the table described in FIGS. 3 and 4*a–c* comprises interchanging the supports for table leg elements 2 on folding the table down. In FIG. 3, the leg elements 2 are supported on base 15 of chassis 13. In FIGS. 4*a–c*, the leg elements 2 are supported on the two side walls 23 of chassis 13. Alternatively the elements 2 in the embodiment of FIG. 3 can be supported on the side walls, and those in the embodiment of FIG. 4*a–c* can be supported on the chassis base.

According to another variation, pins 20 (FIG. 3) and pins 25 (FIG. 4*a–c*), or other corresponding guiding means, provided on the lateral edges of table leaf elements 1, can be located at another point, e.g., on the table leg elements 2 or on the chassis base. in this manner, there will be no projecting parts on the lateral edges of the table leaf elements 1.

Pins 20, 25 are merely guidance means. Their function is to cooperate with the corresponding guiding members 19 or 24 to facilitate collapsing and extending the table leaf elements. This feature can also be provided by a sliding surface on the bottom surface of the table leaf elements 1 cooperating with guiding members 19, 24. It is also possible to provide a roller on the bottom of the table leaf in the vicinity of the interconnected table leaf elements 1, while the other table leg elements 2' have a recess receiving the roller when the table is assembled.

While various embodiments have been chosen to illustrate the invention, it will be understood by those skilled in the art that various changes and modifications can be made therein without departing from the scope of the invention as defined in the appended claims.

What is claimed is:

1. A collapsible table, comprising:

more than two table leaf elements;

a support element between every second of said leaf elements, said support element including a crossarm and a leg fixedly coupled to said crossarm adjacent a first edge of said crossarm and extending perpendicularly from said crossarm, said crossarm having a width greater than a width of said leg providing a free edge of said crossarm opposite said first edge and spaced from said leg;

hinges pivotally coupling adjacent ones of said leaf elements to said edges of said support element; and a leg element pivotally coupled at one end to the leaf element coupled to said support element free edge for supporting a joint between a pair of leaf elements, said crossarm having a width greater than widths of said leg and said leg element, said leg element being tiltable to a position with its other end adjacent to said free edge of said crossarm.

2. A collapsible table according to claim 1 wherein said crossarm comprises a top surface substantially coplaner with top surfaces of said leaf elements in an erected position.

3. A collapsible table according to claim 1 wherein said leg element is pivotally coupled to a bottom surface of the respective leaf element.

4. A collapsible table according to claim 1 wherein a chassis receives said leaf, support and leg elements in a collapsed, storage position, said chassis having an open side for loading and unloading said elements, said elements being stored on said chassis in a juxtaposed vertical manner parallel to said open side.

5. A collapsible table according to claim 4 wherein said chassis comprises a guiding member mounted thereon and said elements comprise guided members extending laterally therefrom and engaging said guiding member during erecting and collapsing of said elements to control movement thereof.

6. A collapsible table according to claim 5 wherein said guided members comprise pins.

7. A collapsible table according to claim 5 wherein said guided members comprise sliding surfaces.

8. A collapsible table according to claim 5 wherein said guided members comprise rollers.

9. A collapsible table according to claim 5 wherein said guiding member is collapsible.

10. A collapsible table according to claim 5 wherein said guiding member is movably mounted on said chassis.

11. A collapsible table according to claim 5 wherein said leg elements are supported on a bottom member of chassis in the collapsed position.

12. A collapsible table according to claim 5 wherein said chassis comprises displaceable stop means for securing said leg elements in vertical positions.

13. A collapsible table, comprising:

first, second and third table leaf elements;

a first support element between said first and second leaf elements, said support element including a crossarm and a leg fixedly coupled to a first edge of said crossarm and extending perpendicularly from said crossarm, said crossarm having a free edge opposite said first edge and spaced from said leg;

hinges pivotally coupled said first edge to said first leaf element, said free edge to said second leaf element, and said third leaf element to an edge of said second leaf element remote from said support element; and a first leg element pivotally coupled at one end to said second leaf element for supporting a joint between said second and third leaf elements and for supporting said second and third leaf elements, said crossarm having a width greater than widths of said leg and said leg element, said leg being tiltable to a position with its other end adjacent said free edge of said crossarm.

14. A collapsible table according to claim 13 wherein a second element, essentially identical to said first support element, is hingedly coupled at a first edge thereof to an edge of said third leaf element remote from said second leaf element.

15. A collapsible table according to claim 14 wherein a fourth leaf element is hingedly coupled to said second support element of a free edge thereof; and a second leg element, essentially identical to said first leg element, is pivotally coupled to an edge of said fourth leaf element remote from said second support element.

* * * * *